United States Patent [19]

Crump

[11] Patent Number: 4,642,612

[45] Date of Patent: Feb. 10, 1987

[54] INTRUDER DETECTION AND DETERRENT SYSTEM

[76] Inventor: Herschel W. Crump, 117 Yuchi Trail North, Fort Worth, Tex. 76108

[21] Appl. No.: 621,704

[22] Filed: Jun. 18, 1984

[51] Int. Cl.[4] ..... G08B 13/00

[52] U.S. Cl. ..... 340/541; 340/506; 340/523

[58] Field of Search ..... 340/506, 507, 508, 523, 340/511, 521, 526, 541

[56] References Cited

U.S. PATENT DOCUMENTS

| | | | |
|---|---|---|---|
| 3,599,195 | 8/1971 | Boyko | 340/521 X |
| 3,828,338 | 8/1974 | Kato | 340/526 |
| 3,900,841 | 8/1975 | Buckles | 340/541 X |
| 4,057,791 | 11/1977 | Bimmerle et al. | 340/566 X |
| 4,195,286 | 3/1980 | Galvin | 340/501 |
| 4,206,450 | 6/1980 | Harden et al. | 340/514 X |
| 4,287,515 | 9/1981 | Raber et al. | 340/506 X |
| 4,356,476 | 10/1982 | Healey et al. | 340/511 X |
| 4,410,884 | 10/1983 | Heiland | 340/523 X |
| 4,568,920 | 2/1986 | Mombelli | 340/566 X |

*Primary Examiner*—James L. Rowland
*Assistant Examiner*—Brian R. Tumm

[57] ABSTRACT

The present invention discloses a staged system for both detecting and deterring intruders into a closed space such as a home or business. The staged system provides varying responses according to the degree of penetration of the intruder into the protected area.

9 Claims, 2 Drawing Figures

INTRUDER DETECTION AND DETERRENT SYSTEM

BACKGROUND OF THE INVENTION

The present invention is related to intrusion detection systems and more specifically involves a system for both detecting intruders and for presenting signals to the intruders to deter them from further depth of intrusion.

Many detection systems including alarms and automatic locking systems are disclosed in the prior art. These systems are directed solely toward the objective of detecting an intrusion after the fact and generating an alarm to some point distant from the intrusion. None of the conventional devices has as a primary function the prevention of further intrusion by the burglar or unwanted visitor. Most of the prior art devices available today consist of what is known as "perimeter systems". The typical perimeter system comprises a ring of detection devices around an area such as a home or business providing a single line of defense. Usually these detection devices comprise switches connected to a central alarm system to indicate to the occupants that the perimeter system has been violated. The disadvantages of this system are severe. One such disadvantage is that the system gives no warning until the intruder has penetrated the protected area. At this time a relatively defenseless homeowner may be faced with an armed intruder bent on committing crimes of burglary, or worse, within the homestead. Another disadvantage is that once this type of system is tripped, it cannot reset unless all switches happen to return to their normal state. One example of a typical perimeter system alarm is that disclosed in U.S. Pat. No. 4,206,450 to Harden, et al. This patent discloses a perimeter fire and burglar alarm system having a series of sensors wired around the perimeter utilizing timers to allow the time of the alarm to be set or to allow the owner of the alarm to set the alarm and leave without tripping it. Once any one of the sensors is tripped by any of the expected events, such as intrusion or fire, the system immediately goes into the alarm mode, or else after a set time period goes into an alarm mode. This system can provide no further action with respect to the intrusion or fire. Thus, the Hardin patent discloses a standard perimeter alarm system adapted to provide a single alarm signal in response to a single sensed event.

Another example of a perimeter system providing a single alarm signal is that disclosed in the Burney patent, U.S Pat. No. 3,543,261. Burney discloses a single alarm system having a spacially separated set of sound detection sensors which are adjusted to avoid false alarms. Another example of a single alarm perimeter system is that disclosed in U.S. Pat. No. 4,385,287 to Eatwell. Although the sensors and the signaling apparatus are more sophisicated than that of conventional devices, the system is still a single alarm perimeter type system.

The patent to Boyko, U.S. Pat. No. 3,599,195, discloses a dual alarm intrusion detection system which utilizes motion sensors and heat/smoke detectors. The Boyko alarm utilizes only two alarms. One sensor can actuate both alarms. This system can detect intrusion only, or fire only, and has no sensor lockout, or capability for further detection after a sensor has been tripped. The patent to Ferrigno, U.S. Pat. No. 3,221,317, discloses a battery operated sensor system which senses moisture or other conditions and generates a sound signal through a public address system speaker. The patent is directed to a battery saving feature of this simple perimeter system. The system is intended to primarily convert natural phenomenon such as moisture or lightning, or changes in brightness, sound, voltage, current, and other natural phenomenon directly into electrical currents which then may be converted to audible signals. The patent to Forbat, U.S. Pat. No. 3,979,740, discloses a monitoring system which can be used as an intruder alarm. The system is primarily designed to prevent the generation of false alarms. The system is a perimeter system that has the capability of counting a number of intrusion pulses during a set period of time and then actuating a single alarm. The system has various means to filter out false signals. The system is limited in that once it has determined that an intrusion has occured it is limited in response to a single alarm.

U.S. Pat. No. 3,261,009 to Stetten, et al. is directed to a personnel sensing device utilizing seismic sensors. This system features filters for reducing false signals and utilizes timing circuits to respond only to a predetermined pattern of seismic signals. Once the system has determined or "recognized" the predetermined pattern, a single alarm is generated.

The patent to Galvin, U.S. Pat. No. 4,195,286, discloses a simple two stage system utilizing a single sensor to set off a first stage and two sensors to set off a second stage. The Galvin system requires both stages to go off almost simultaneously. The defect in this system is that the activation of a second stage at a spaced interval from the first stage will not provide the proper alarm response. Also if a single sensor is disabled no further capability is recognized in the system. The primary object of the Galvin system is to provide "overlapping coverage". The patent to Buckles, U.S. Pat. No. 3,900,841, discloses a purely mechanical system utilizing mechanical timers, gear systems, and screw drives. Also cams, switches, and motors are utilized. The Buckles system is slow to respond to multiple stimulations because of the mechanical drive. Also any sensor which is activated will continue to drive and actuate the entire system. It cannot be reset with any open or disabled sensor. The Buckles system is not satisfactory for an external perimeter system. It utilizes a "free period" when no alarm is given. Also the Buckles system lacks the ability to totally reset the timers because of its mechanical linkage. Also the system resets only if all sensors are in their normal position. Thus the Buckles system is a very inflexible unreliable system because of the purely mechanical timed actions of the system. Very little adjustment can be achieved with the Buckles intrusion system. The Buckles system also lacks the deterrent capabilities of the present invention.

All of the aforementioned conventional alarm systems suffer from the disadvantages that they generally rely upon a single, or at most, a double tripping of external sensors. They suffer from a further disadvantage that the alarm generated in response to the one or two sensors is a single alarm and usually occurs after the undesirable intrusion has occured. The conventional systems offer no deterrent capabilities for preventing the undesired intrusion. Furthermore the systems lack automatic resetting capabilities after one or more of the sensors have been tripped.

SUMMARY OF THE INVENTION

Currently available burglar alarm devices employ some sophisicated circuitry to coding, delay options, and/or telephone system interfacing. These units do not however employ logic in determining the presence of unauthorized persons on the protected premises. Perimeter protection systems, whether wireless or hardwired, do not report or alarm until the perimeter is violated. This results in damage to the premises and possibly even to its occupants before the alarm sounds and other programmed actions can begin. Also this type of system cannot reset itself if the forced entry causes a switch to remain opened or closed (depending on the type circuit employed) and the property owner is then unprotected, even though the system may be very sophisticated, if just one switch is left in a tripped position. These systems require a resetting of sensors to their original position and repairing the damage done during the forced entry and also the resetting of the alarm to again have the protection the property owner intended. Placing sensors outside the home perimeter using conventional systems would also result in numerous unacceptable false alarms from stray dogs, cats, children, birds, and other sources which would also result in disabling the system until the circuits are restored after each triggering. Automatic phone-in devices to police departments and security bureaus would also be accidentally activated in cases where no actual entry has been attempted or intended. Thus, people employing such conventional systems must accept the fact that the sensors must be located so that the system will not alarm until forced entry and associated damage has occurred; the system may not reset after such an event depending on the condition the perimeter wires and switches are left in; and the security cannot be assured after an alarm sounds without a knowledgable person verifying the condition of the structure, the premises, and the alarm system wiring.

Thus, the present invention provides a system which may be utilized either as a supplement to a standard peripheral wired system or it may be used alone as an intrusion detection and deterrent device. The present invention discloses a logic device that detects and reacts to an intruder before he actually intrudes into the protected area. The logic function of the system insures that alarms are not sounded for normal access activities such as mail delivery, meter readers, salesmen, children, animals, and the like. Also the system discloses adjustable timers in the logic circuit to enable the system to be tuned to each specific protected area and security problem to provide an optimum level of protection not available through any currently available security system. The tuning of the system reduces or eliminates nuisance alarms while still providing early detection as well as early deterrence of the intruder.

DESCRIPTION OF THE PREFERRED EMBODIMENTS

Figure 1:
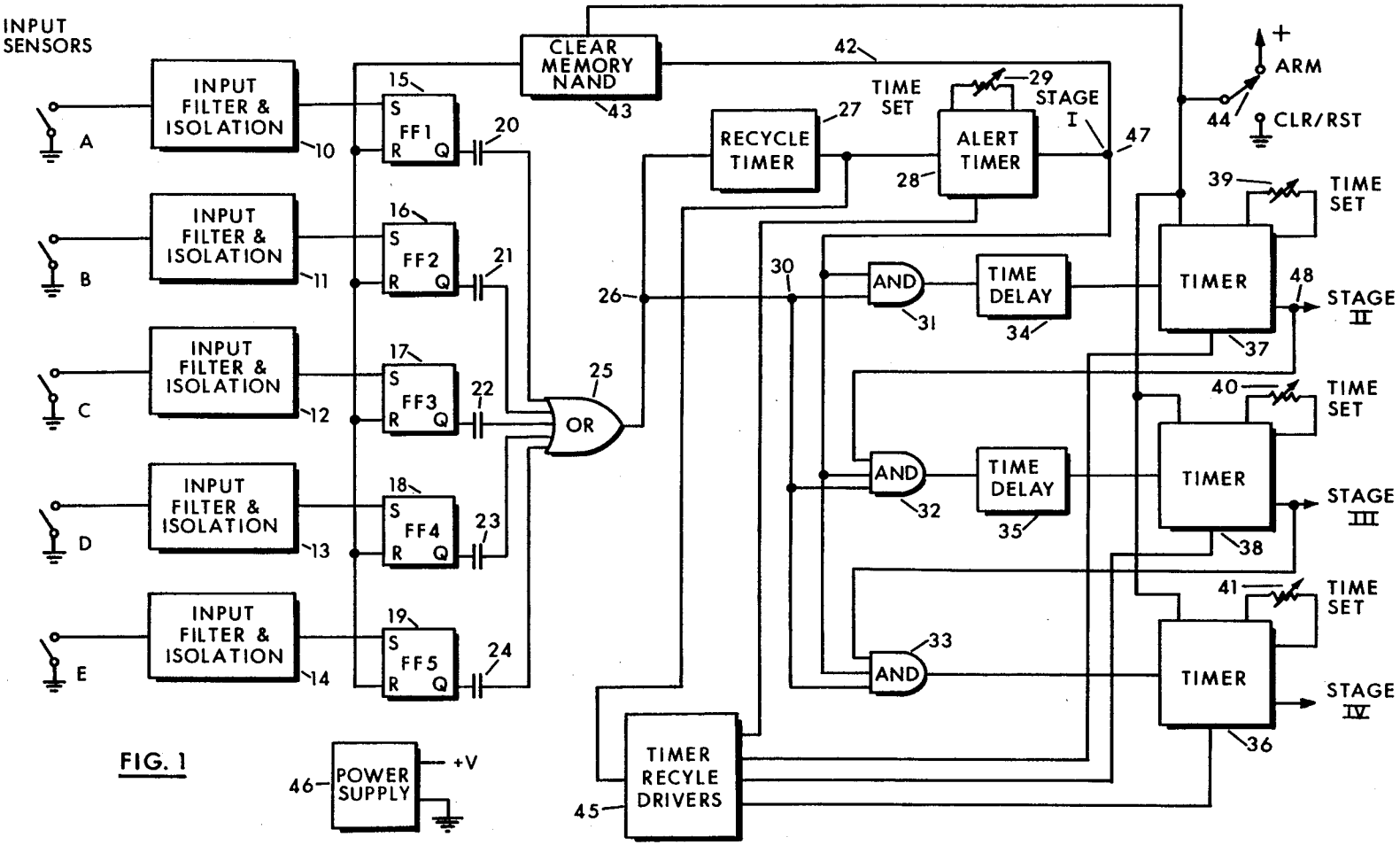
FIG. 1 is a diagram indicating the logic circuit for one embodiment of the invention.

The logic system employed in this unit is based on the following assumptions and generalizations:

(1) Most thieves and intruders prefer to enter a home or business property when the owners are absent and they will go to extraordinary lengths to insure that the property is vacant before entering.

(2) The intruder will most likely have some pretense or excuse for being present on the property, for example, as a salesman or charity worker he will normally make his initial approach to the front door.

(3) The intruder does not normally employ forcible entry without first checking to see if a door or window has been left open which would allow easy entry and a possible alibi.

(4) The intruder will not remain outside the home for an extended period of time before attempting a forced entry in order to minimize his chances of being observed.

(5) If a potential intruder believes strongly enough that there may be someone in the home or business he will more than likely look for another place to burglarize.

(6) If an alarm sounds or the burglar fears he has been detected before he has committed a crime he will probably leave the premises without doing so.

The present system utilizes detection devices for inputs to a logic system which can be varied to suit each particular application. Simple reed switches which may be magnetically actuated can be placed on screen doors, storm doors, window screens, and other perimeter entry areas around a building or home. Also sensors or switches can be wired in conjunction with doorbells, gates, and pressure switches on the porch or sidewalk area to a home or building. Other sensors can be utilized in conjunction with a telephone since intruders often call a business or home to determine if there is anyone present. Other sensors such as motion detectors, infrared detectors, lighting detectors, pressure sensitive mats, trip wires, sound actuated switches, vibration actuated switches, or any other type of detector can be located at various locations out from the edge of the building or home.

Actual location of detectors, as well as the selection of detector types, can be determined by the structure to be protected. As an example, a person utilizing the system may wish to protect the average residential home having an attached garage, a screen patio, a fenced backyard with gates, storm doors, and screened windows. Detectors can be placed in such areas as the doorbell switch, gate switches, screen doors, and window screens. One key feature is to determine the paths of probable entry by a potential intruder and to place sensors along each potential path to detect activity in multiple areas and provide staged responses to the pending intrusion.

The multiple switch concept of the present invention thus allows a multiple response to a series of access paths attempted in a pending intrusion. As an example, if sensors are established on the doorbell, the front screen door, and the rear screen door of a residence, the system will elevate its status when the potential burglar rings the doorbell to determine if anyone is at home. No noticeable response will be triggered at this stage.

If the potential intruder then opens the screen door to gain access to the front door either to knock or check the security of the door, the sensor in the screen door can then activate a second stage function to provide a noticeable response such as turning on the interior lights in the home or turning on the porch light. Alternative responses could be the initiation of a tape recording of a dog barking or other audible response inside the home. Hopefully this response would serve to deter further attempts because of the intruders belief that someone may be home. Should the intruder still not be deterred and continue to check for other access paths, sensors located in his paths to the other possible entry points will provide further deterrence. Activation of a third sensor switch will serve to initiate an audible alarm which may also be tied in by telephone and/or radio signals to a central security station. Alternatively, the third sensor could activate another response and leave the audible alarm for a fourth activation. Thus the present invention utilizes a set of multiple sensors placed along the possible paths of intrusion to provide staged responses hopefully to deter the final intrusion into the protected area.

Referring now to FIG. 1, a preferred embodiment of the system is illustrated in the logic flow diagram. In this system five input sensors are utilized and denoted as A, B, C, D, and E. Each input sensor, which could comprise a normally closed magnetic reed switch or any one of the aforementioned types of sensors, is functionally connected to an input filters 10–14. These filters serve to isolate the sensors from the logic and activation circuits in order to filter out "noise" and extraneous signals possibly picked up by the wiring of the sensors or any of the sensor metallic components.

Each input filter 10 through 14 is connected to the set terminal of a flip-flop 15 through 19. The output of each flip-flop is connected by a capacitance element 20 through 24 to the inputs of an OR gate 25. The single output from the OR gate 25 is transmitted to a junction 26. One lead from junction 26 is connected to recycle timer 27. The output of timer 27 connects to adjustable timer 28 having an adjustment circuit 29 therein. The second lead from junction 26 passes to a second junction 30 having a first lead going to an AND gate 31 and a lead to AND gates 32 and 33. Each of the AND gates 31 and 32 has a single output communicated to time delays 34 and 35 respectively. The output of AND gate 33 is communicated directly to timer 36. The output of time delay 34 is communicated to timer 37 and the output of time delay 35 is connected to timer 38. Each of the timers 36 through 38 is an adjustable timer having manual setting means 39 through 41 thereon. The output of timer 28 is connected to the second input terminals of the AND gates 31 through 33. The output of timer 28 also is connected by line 42 to a pulse amplifer 43 which in turn is connected to the reset terminals of flip-flops 15 through 19.

A manual switch 44 is provided to allow the system to be deactivated and reset. Circuit 44 consists of a spring loaded switch with an "arm" (alarm system activated) position and a "clear/reset" (spring loaded) position to provide these two functions. When the switch is in the clear/reset position, timers 28, 36, 37 and 38 are cleared to their unactivated state and by means of pulse amplifier 43, the flip-flop elements 15 through 19 are reset to their untriggered state. When the switch is placed in the arm position, the alarm system is armed and ready for service.

The output of recycle timer 27 is also connected to timer recycle driver 45 having outputs to timers 28, 36, 37 and 38. The recycle driver outputs clear to zero the accumulated time of timers 28, 36, 37 or 38 that are in the process of a timing cycle.

It should be noted that the burglar deterrent system depicted in the logic diagram of FIG. 1 is arranged to provide a multi-stage response wherein the first stage is dedicated to "waking the system up" or placing the system in a "stage of increased alert". This is optional with the present invention and is utilized to avoid positive responses in the system to what would normally be considered false alarms such as pets, salesmen, meter-readers, etc. Thus by the dedication of the first stage of the system to merely placing the system at a higher degree of alert, such false alarms are effectively filtered out.

In typical operation, an intruder into a protected system having the elements illustrated in FIG. 1, would first activate one of the sensors A through E. This first stage activation of a single sensor might be the ringing of a doorbell or the opening of a gate in a fence surrounding the premises. As a result of the activation of the first sensor which as previously noted could be an entirely innocent activation by a well intentioned party, a signal is passed to the flip-flop 15 through 19 associated with the tripped sensor. This signal initates a change in state of the associated flip-flop output. The resulting signal generated by the change in the flip-flop state is passed through its associated capacitance element resulting in a pulse of signal at the input of OR gate element 25. The pulse passes through the OR gate 25 to junction 26 where it is routed to AND gates 31 through 33 and recycle timer 27. The pulse at junction 26 triggers recycle timer 27 starting its time cycle. The output of recycle timer 27 clears timers 28, 36, 37 and 38 to zero by means of timer recycle driver 45. Timer 27 also prevents undesirable cascading of signals in the system. At the conclusion of the time period of timer 27 the high-to-low signal transition at the output of timer 27 triggers timer 28. Timer 28 begins its timing in response to this signal from timer 27 and, during the amount of time which has been preset by adjustment 29, timer 28 generates an output signal to junction 47. This output signal is simultaneously transmitted to the AND gates 31, 32 and 33.

At this point in time one signal input sensor has been tripped, generating a single signal from OR gate 25, activating timer 28 and placing the system in an "alert" status. As long as timer 28 continues generating an output signal in response to the present adjustment 29, the system is in the aforementioned increased state of alert. Should a second sensor A through E now be tripped during the time cycle of timer 28, a second input signal is transmitted to the OR gate 25 which communicates the signal through junction 26 directly to AND gates 31 through 33. At this point in time, since all conditions for activating AND gate 31 are simultaneously fulfilled, an output signal is generated from AND gate 31 which passes through a time delay 34 and triggers adjustable timer 37, generating an output signal at output lead 48. This in effect, has activated stage two of the deterrent system. The system output for this activation is the closing of a relay contact to activate a device for providing some positive indication or action within the premises or outside the premises to deter any possible intruder who may be considering entering the premises.

Thus, the activation of the first stage and then an activation of an additional sensor within the time duration of timer 28 will initiate stage two response which can be tied into any deterrent element desired by the property owner. For example, it is believed that stage two could be connected to a porch light or an interior light such that when stage two is activated by timer 37, the aforementioned light could be turned on and a very strong deterrent created against further intrusion into the premises.

The activation of the second sensor also resets timer 28 to zero time by means of recycle timer 27 and recycle driver 45. If, during the timing period of timer 28 and timer 37 a third sensor is tripped, the signal from the third sensor moves through its respective flip-flop, OR gate 25, and junction 26 to combine with the output signals from junction 47 and timer 37 to activate AND gate 32. These three signals to AND gate 32 thus generate a signal through time delay 35 and timer 38, thereby activating stage three of the system. Stage three can be an even further or stronger response to the attempted intrusion such as dialing a predial alarm system or other deterrent activation. For example, stage three could turn on a radio or tape recorder inside the home or could be used as a combination action to do any of these actions in addition to turning on all exterior lights. The activation of the third sensor also resets timer 28 and timer 37 to zero time by means of the timer 27 and recycle driver 45.

A fourth sensor activation such as an actual entry into the home while adjustable timers 28 and 38 are running will serve to activate AND gate 33 thereby initiating the final stage of the deterrent system. Activation of the fourth sensor also resets timer 28, timer 37 and timer 38 to zero time by means of timer 27 and recycle driver 45. The final stage could be either an internal or external alarm or such an alarm combined with a phone-in warning system to a central alarm bureau.

Thus, the logic system disclosed in FIG. 1 provides a staged response to a multiple-point entry system. Each successive stage of the response is activated by stimulation of an additional sensor. Each stage is also related by time elements to the preceding stage such that seperate unconnected activations of the sensors normally will not combine to stage the alarm system into a higher deterrence level. The operation of the "alert timer 28" allows the system to automatically reset back to the unactivated condition following accidental or single intentional activations of the sensors. The reset of the system commences when timer 28 completes its time cycle as denoted by a change in its output from a high to a low signal level. This condition activates pulse amplifier 43 which generates a pulse that resets flip-flops 15 through 19. After receiving the reset signal, the flip-flops are ready to receive new trip signals from input sensors A through E. Reset of timers 36, 37 and 38 is accomplished by the timer completing its time cycle. If immediate termination of the timer cycle is desired, activation of switch 44 to the clear/reset position accomplishes this.

One distinct advantage of the present invention is that a burglar cannot pass by the homestead and set off the alarm then leave immediately and wait until a neighbor or policeman comes in and shuts off the alarm, then return later with a deactivated alarm to enter the premises undetected. Should this be attempted with this system, the alarms will have been automatically reset after preset time periods. Upon return of the burglar to the protected premises, entry would be detected and deterred by the sensors and alarms. If any sensors are left in an open position, negating their operation, the system will continue to function. It will count the open (tripped) sensors as a vote each time timer 28 cycles through; thus maintaining the system at the "alert" response level. With stage one thus operational, all additional inputs will trigger a response at one level higher than if all sensors were closed. As a result, some deterrent capability remains in the system as long as just one sensor remains operational and unactivated.

Figure 2:
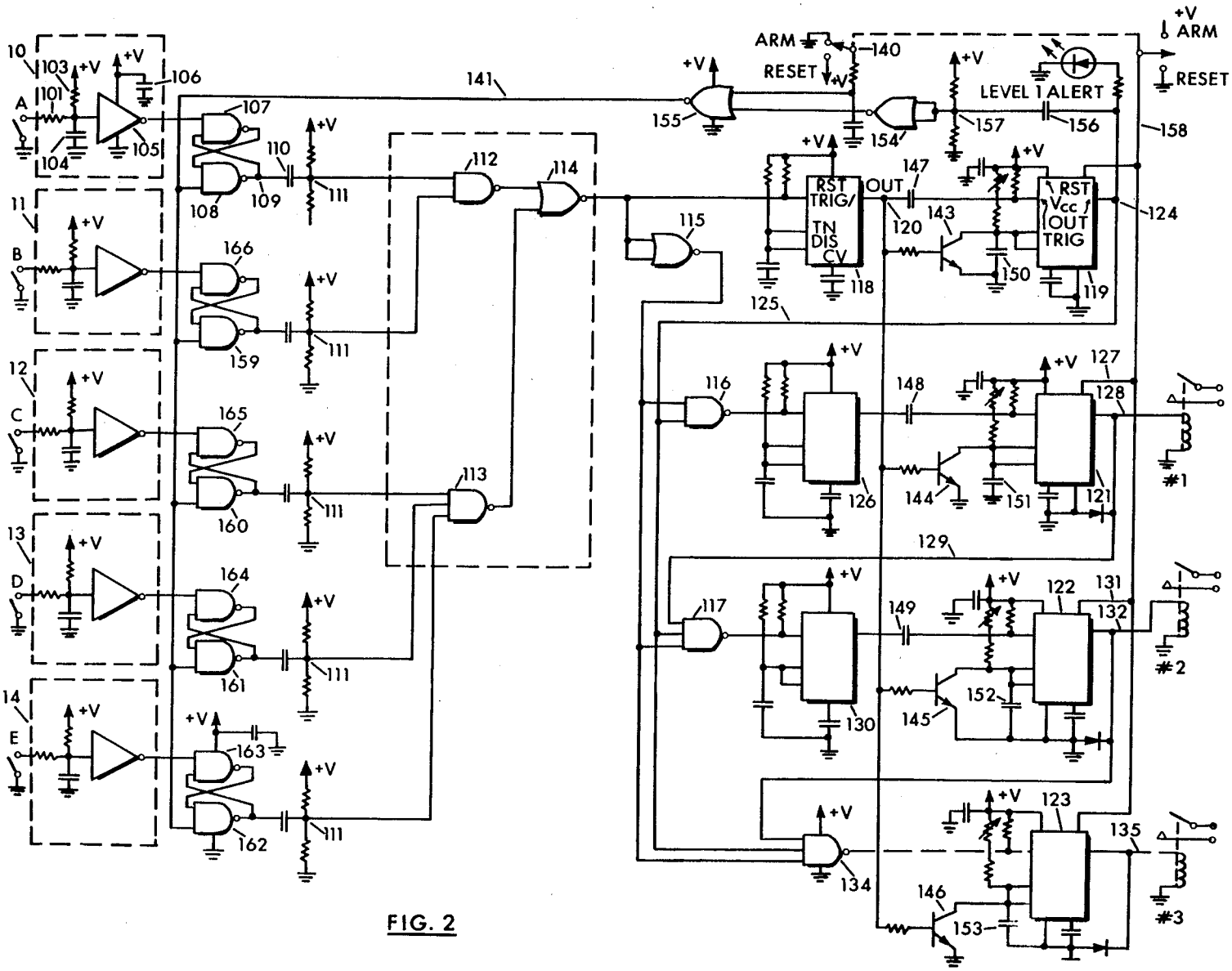
FIG. 2 is a circuit diagram illustrating solid state electronic components which can be used to obtain the embodiment of FIG. 1.

Referring now to FIG. 2, there is illustrated a circuit diagram containing the electrical components which can be utilized in one embodiment to form the invention disclosed in the logic circuit of FIG. 1. The input filter and isolation circuit 10 of FIG. 1 are represented in the phantom block 10 shown in FIG. 2. The particular electronic components comprising element 10 are a resistor 103 connected to a 5 volt DC voltage source, an input resistor 101, an inverter element 105 and a capacitor 104. When an input sensor is closed (untripped) the voltage divider action of resistors 103 and 101 result in a low signal level at the input of inverter 105. When the input sensor is open (tripped) the voltage at the inverter input is no longer divided by resistors 101 and 103, resulting in a high signal level at the input of inverter 105. Capacitor 104 operates in conjunction with resistors 101 and 103 to filter out undesirable noise signals that may be picked up by the sensor wiring. This combination of components forms the input filter and isolation element 10 of FIG. 1. A similar set of components is utilized to form similar filter and isolation elements 11 through 14. The output of element 10, (low signal when the sensor is open or tripped and high signal when the sensor is closed or untripped), is communicated to NAND gate 107. NAND gates 107 and 108 are connected together to form a bistable element known as an RS (reset, set) flip-flop which is an element having two stable states. Specific combinations of signals at the set and rest inputs will cause the flip-flop to change from one stable state to the other. The flip-flop filters out repeated signals at any one sensor so that only the first input signal activates the flip-flop output signal and subsequent activations of the same sensor are ignored unless the flip-flop has been reset by a signal from the reset circuity 155, 154, 157 and 156. The low signal received from inverter 10 as a result of the opening of the sensor A, sets the flip-flop, resulting in a change from a high signal condition to a low signal condition at junction 109. This transition of signal from high to low reacts with capacitor 110 to provide a momentary dip in applied voltage at junction 111. This dip or pulsation is read as a change from a high signal, to a low signal, to a high signal by NAND gate 112. It should be noted that the low signal from inverters 105 works in conjunction with a high signal in circuit 141 to set the flip-flop 107/108. Similarly, a high signal from inverter 105 works in conjunction with a low signal in circuit 141 to reset the flip-flop 107/108. Flip-flop elements comprising bistable elements having two NAND gates are utilized with sensors B through E, identical to those of sensor A as illustrated in FIG. 2. Likewise, each flip-flop output is connected through a capacitor and a voltage/resistance circuit to provide a single pulsed output as described with respect to sensor A and element 10.

The OR gate 25 of FIG. 1 is represented in actual components in the embodiment of FIG. 2 by the use of NAND gates 112 and 113 and NOR gate 114. Due to the continuous high signal arising from voltages 111, all of the inputs of the NAND gates 112 and 113 are continuously high, resulting in low outputs from the two NAND gates into the NOR gate 114. Due to the low outputs from the NAND gates 112 and 113, the output of the NOR gate 114 is continuously high.

The A signal generated by the activation of any of the sensors A through E will trip the relevant flip-flop and create a pulse in voltage 111 at the input of the corresponding NAND gate 112 or 113. The generated voltage pulse is sensed by one of the NAND gates 112 or 113 and, as a result, the condition for activating one of the NAND gates no longer exists. At this moment in time, the low signal pulse at the NAND gate input wil be converted to a high signal pulse at the corresponding NAND gate output. This high signal pulse will be transmitted to the NOR gate 114 input resulting in a low signal pulse at the NOR gate 114 output. Thus, the two NAND gates 112 and 113 in series with the NOR gate 114 serve the same function as the OR gate 25 of FIG. 1. A dip or pulse in voltage at any of the five inputs of NAND gates 112 and 113 is thus converted to a dip or pulse in voltage at the output of NOR gate 114. The output of NOR gate 114 is normally a high signal that is pulsed to a low signal condition for approximately 10 microseconds as a result of a sensor trip action setting a flip-flop. This low signal pulse is connected to NOR gate 115 which functions as an inverter element. The output of NOR gate 115 is a high pulse that is connected to an output of NAND gates 116, 117 and 134.

The low signal pulse from NOR gate 114 is also simultaneously transmitted to timer 118 which represents recycle timer 27 of the logic circuit of FIG. 1. The low pulse from NOR gate 114 triggers timer 118 having a time duration of approximately 0.1 seconds. The output of timer 118 is transmitted to transistors 143, 144, 145 and 146. These transistors and associated base resistors comprise the timer recycle driver 45 of FIG. 1. The time duration of timer 118 is sufficient to allow the timer recycle driver transistors 143,144, 145 and 146 to discharge to zero the timing capacitors 150, 151, 152 and 153.

The output of timer 118 is also transmitted by junction 120 to timer 119 via capacitance element 147. At the conclusion of the time period of timer 118, the high-to-low signal transition triggers timer 119, starting its time cycle. The output duration of timer 119 is set by timing capacitor 150, resistor 142 and adjustable resistor $R_{A1}$. The output signal is a high signal and results in a timed high output at junction 124. This high output is communicated by lead 125 to the input terminals of the three NAND gates 116, 117 and 134, thus providing a high level input signal at these NAND gates. This input signal is maintained during the entire timing cycle of timer 119. Timer 119 comprises the first stage or "increased alert" stage of the deterrent system corresponding to element 28 of FIG. 1. The duration of increased alert is set by the action of timer 119 which can be adjusted by the operator of the system through the use of adjustable resistor $R_{A1}$. As long as timer 119 is running, the high signal communicated by NAND gates 116, 117 and 134 provides a high signal at one terminal to each of these gates.

During the generation of a high signal by timer 119, should a second sensor A through E be activated, a low signal pulse will be generated from NOR gate 114 which in turn causes a high signal pulse at the output of NOR gate 115. The high signal pulse from NOR gate 115 is applied to the second terminal of NAND gates 116, 117 and 134. This high signal pulse combined with the high signal output from timer 119 causes a low output from NAND gate 116 which triggers timer 126. Simultaneously, the low signal pulse from NOR gate 114 also triggers timer 118.

As mentioned previously timer 118 activates the timer recycle driver transistors 143, 144, 145 and 146 which discharges timing capacitors 150, 151, 152 and 153, thereby resetting the corresponding timers to zero. Then the accumulated time period in timer 119 is reset to zero and it restarts its timing cycle. NAND gates 117 and 134 do not respond to the high signal pulse from NOR gate 115 since less than the required three input high level signal conditions exist at that point. Timer 126 has a short timing cycle of approximately 1 millisecond to prevent undesired cascading of signals to NAND gates 117 and 134. At the conclusion of the timer 126 timing period, the high-to-low signal transition triggers timer 121.

During the running of timer 121, a signal is communicated via lead 128 to the first positive action response element (not shown) previously described as the deterrent action such as turning on porch lights, radios, etc. Also, timer 121 is communicated via lead 129 to the third terminal of NAND gate 117. Thus, NAND gate 117 is now two-thirds activated by the combination of the output of timer 121 and the output of timer 119. Should a third sensor A through E be tripped in addition to the previously tripped two sensors, this will generate an output through NOR gate 114 and NOR gate 115, thereby providing the third needed input to NAND gate 117 and a pulse through timer 130. This timer serves a purpose similar to timer 126 previously discussed of delaying the pulse from NAND gate 117 by approximately 1 millisecond before triggering timer 122. The low pulse from NOR gate 114 also triggers timer 118. As previously mentioned, timer 118 activates the timer recycle driver transistors 143, 144, 145 and 146 which discharges timer capacitors 150, 151, 152 and 153 thereby resetting the corresponding timers to zero. Hence, timer 119 and timer 121 accumulated time periods are reset to zero and they re-initiate their timing cycle. The output signal from timer 130 triggers timer 122 which begins its timing cycle. A high output signal is present at line 132. The high signal level represents the second level of active response and is one of the aforementioned described deterrent responses. In addition to activating the second stage active response, the high signal from timer 122 to NAND gate 134 provides the second of three required inputs to this element. The first such signal is provided by the alerting of the system via timer 119. The third input required by NAND gate 134 is supplied by activation of a fourth sensor A through E in addition to the three previously activated sensors. As previously described, the activation of the fourth sensor is communicated through NOR gates 114 and 115 to the third input terminal of NAND gate 134 thereby activating the fourth stage timer 123 and initiating the third level response at line 135. Concurrent with the activation of the third terminal of NAND gate 134, the signal from NOR gate 114 also triggers timer 118.

As previously discussed, the output signal of timer 118 activates the timer recycle driver transistors 143, 144, 145 and 146 which discharge timing capacitors 150, 151, 152 and 153 thereby resetting the corresponding timers to zero. Thereafter, timers accumulated time periods in timers 119, 121 and 122 are reset to zero and they restart their timing cycles. The third level response may be any active response desired by the owner or occupier of the premises such as external alarms, internal alarms, automatic telephone dialers, etc. This alarm response will continue for as long as the time period previously set into the timer by means of adjustable resistance.

Automatic reset of the system occurs when timer 119 times out and its output signal at junction 124 changes from a high level to a low level. This change in level is transmitted through capacitor 156 to junction 157 which causes a dip in voltage at junction 157. This dip in voltage represents a change from a high signal level to a low signal level and back to a high signal level. It is transmitted through NOR gate 154 where it is inverted and transmitted through NOR gate 155, and then again inverted. The signal at the output of NOR gate 155 is normally a high signal and, at the occurrence of the timing-out of timer 119, it pulses to a low signal level for approximately 60 microseconds and then returns to a high signal level. This signal is connected to the reset input of the NAND element flip-flops 108/109, 159/166, 161/164 and 162/163 via line 141. This signal resets each of the flip-flops so that they can receive new trip signals from the sensors A through E. Timers 121, 122 and 123 reset when the timing cycle controlled by the setting of the adjustable resistors is completed.

Manual reset of the system is accomplished with a double-pole, double-throw switch 140/157. The "clear/reset" position of the switch is spring loaded and, when released, returns to the "arm" position. When in the "clear/reset" position, switch section 157 resets timers 119, 121, 122 and 123 to an untripped state which returns output lines 128, 133 and 135 to a low level condition. When the switch is released, it returns to the "arm" position and the timers are ready to receive signals as described previously. The remaining switch section 140 in the "clear/reset" position places a high signal level on the input of NOR gate 155 which causes a low signal on line 141. This low signal level resets the NAND element flip-flops 108/107, 166/159, 160/165, 161/164 and 162/163. When the switch is released, it returns to the "arm" position and the flip-flops are ready to receive new trip signals from sensors A through E.

The circuit of FIG. 2 uses commercially available resistors, capacitors, transistors and integrated circuits. The integrated circuit logic elements are commercially available transistor-transistor logic (TTL) types. NOR elements are sold under the designation SN7402N, NAND elements are designated SN7400N (2 input type) and SN7410N (3 input type). The inverter element is designated as SN7404N. The timers are type 556 elements. These elements are manufactured by Texas Instruments, Inc.; Signetic Corporation; National Semiconductor, Inc. and others.

Thus, it has been shown by the use of FIGS. 1 and 2 how the present invention discloses a warning and deterrent system for the use around protected premises. The system provides a multi-level response system having both time elements and awareness levels, in addition to varying response levels. The system comprises at least two stages of response wherein the first stage is merely an increased awareness level and the second and succeeding stages provide increased levels of active response associated with the protected premises. Each stage of the system contains a main timer having an adjustable timing function which can be set by the owner and operator of the protection system. Upon the occurrence of an event which activates any one of the remote sensor switches the system is placed in a readiness state comprising an increased alertness. This generates a first signal to the second stage which is held at the entrance of the second stage during the time period of the first stage main timer. As long as no second sensor is activated to generate a second signal to the entrance to the second stage, the second stage will not become activated. The second stage thus remains in an alert state as long as the main timer of the first stage is generating its output signal during its preset time cycle. Should a second or additional sensor be activated while the first stage is in its positive alert status this will fullfil the requirements of the second stage entrance, i.e, two input signals, and thus the second stage will be activated, simultaneously resetting the main timer of the first stage and beginning the timed high signal output of the second stage. Simultaneously with the running of the second timer, a first active response may be initiated somewhere in or around the premises. Such first stage response might be the turning on of lights and/or sound systems to deter further approach and/or intrusion duplicated from preceding stage into the protected premises. Thus, each succeeding stage provides a higher response to successive intrusion attempts towards the premises and each succeeding stage must be activated while the time-out of the next preceding stage is occurring.

Thus, it can be seen that the present invention comprises a multiple stage deterent system which can be increased from a two-stage response system to as many stages as desired. This can be achieved by the addition of additional terminals to the central OR gate 25 (FIG. 1) plus additional timer systems on the downstream side of the central OR gate. Also additional sensors and flip-flops must be added on the upstream side of the additional terminals provided in the central OR gate. For example, if a system operator desires eight different levels of response corresponding to eight possible sensor switch locations, then eight sensor switches can be utilized by placing one at each such desirable location and providing a flip-flop circuit for each sensor switch used. Then a central OR gate circuit having eight inputs is provided, feeding into a staged response system having eight sets of timing circuits. Since the first of the eight stages is to provide increase awareness in the system, the seven remaining timing circuits will be utilized to provide positive response output. If the operator does not wish to require eight stages for eight sensors, the number of stages can be adjusted to any desirable number with the final stage providing the final desired response output. Or, if desirable, the number of stages can differ from the number of sensors by having more sensors than stages. Also several parallel levels of protection can be obtained by having each round of sensors in a series circuit input to the central OR gate as a single input. Thus, for example if all the gates in a fence are to be protected these preferably would fall within the characterization of a single stage of penetration by possible intruders and should thus be tied in a single series circuit to a single flip-flop circuit connected to the central OR gate.

As an example, a hypothetical premises to be protected comprising a building or home, might have front and back doors, a fence with two gates, and a front walk having a placemat located thereon. Thus, possible placement for sensors would be a pressure switch under the placemat, normally closed reed switches on the door screens, the same type of switches on the gates and additional such switches on the front door and back door and the windows in the building. In addition to these physical switches located on various parts of the premises, additional switches can be used in conjunction with the telephone and the doorbell. It is foreseen that a person coming on the premises and approaching the house up sidewalk would first step on the pressure mat and initiate the first stage of the present deterent system. This would place the system in the increased state of alertness as previously mentioned. If the person then proceeded up the walk and rang the doorbell to determine if anyone was home the second stage would be activated in the system provided that the timing of the first stage was sufficient to allow a person to proceed up the walk from the placemat to the doorbell at the front door. This initiation of the second stage could be utilized to create a positive response in or on the premises to the ringing of the doorbell. One favorable response would be the turning on of the external porch light at that door. Then if the person is a legitimate visitor to the premises probably he will continue ringing the doorbell which will not stage the system any further because of the latch characteristics of the flip-flop associated with that sensor. If the person is a not a legitimate visitor and attempts to open the screen door to see if the front door is locked, a third response can be initiated in response to the activation of the third switch on the screen door. This response could be the beginning of a recording within the home. On the other hand, if the visitor to the premises leaves the premises without opening the screen door, the timers will run out and eventually will be reset through the action of the reset circuit in the system and the system will return to its initial readiness state. Thus, one intent upon entering the premises illegally cannot drive by the house and trip the alarm sensors to generate a false alarm and then return after the alarm has been investigated to enter the premises undetected. In this system a tripping of any one or more of the sensors will initiate certain defined responses and will then allow automatic resetting of the system in case of later intrusion on the property.

Although a specific preferred embodiment of the present invention has been described in the detailed description above, the description is not intended to limit the invention to the particular forms of embodiments disclosed therein since they are to be recognized as illustrative rather than restrictive and it will be obvious to those skilled in the art that the invention is not so limited. For example, it is clear that one skilled in the art can utilize components not disclosed in the circuit diagram of the present invention and still obtain the same equivalent functions of the system. Also it is clear that one can place sensors on various places of their property to achieve various different results than those indicated above. It is also clear to one skilled in the art that the number of sensors and/or the number of stages in the system can be varied to fit any particular configuration of property or premises desired to be protected. Thus, the invention is declared to cover all changes and modifications of the specific example of the invention herein disclosed for purposes of illustration, which do not constitute departures from the spirit and scope of the invention.

The embodiments of the invention in which an exclusive property or privilege is claimed are defined as follows:

1. An intruder deterrence system for protecting enclosed premises, said system comprising:

at least three sensors arranged to be placed incrementally along a path of probable ingress of a potential intruder into the protected premises;

said sensors adapted to emit an electrical signal upon passage thereby by any person;

latching means connected to the signal output of each said sensor and arranged to generate a signal and then latch-over upon receiving the first signal generated by said sensor, and further adapted to thereafter prevent additional signals from said sensor being passed through said latching means until said latching means is reset;

an OR gate means having inputs operably connected to the signal outputs of all of said latching means, and a signal output;

a first staged response circuit connected operably to the output of said OR gate means and having timing means therein including an adjustable timer with a signal input and a signal output, for generating after a predetermined period a first staged response signal in response to a signal received from said OR gate means;

a second staged response circuit comprising a dual AND gate function having signal inputs operably connected to said OR gate and said first staged response signal, and having timing means therein arranged to generate a time delayed signal output in response to a signal input generated by said second staged circuit AND gate means; and, at least one additional staged response circuit comprising an AND gate means having signal inputs numerically coinciding with and operably connected to the staged response signals of all preceeding staged response circuits plus said OR gate means signal ouput, and said additional staged response circuits each having timing means arranged to generate a time-delayed output signal after receiving an input signal from said circuit's AND gate means;

wherein said second and successive staged response output signals are further adapted to initiate noticeable responses in and around the protected premises in response to the possible intrusion.

2. The deterrence system of claim 1 wherein said additional staged response circuits number at least two and each said staged response circuit timing means includes an adjustable timer.

3. The deterrence system of claim 1 further comprising an automatic reset means for resetting said latch means after a predetermined period of time after said sensors are tripped.

4. The deterence system of claim 3 further comprising manual arming and resetting circuit means adapted to reset said latching means and at least one of said timers, and recycle driver means for generating reset signals to each said circuit timing means.

5. The deterrence system of claim 3 wherein said sensors comprise at least one normally-closed electrical switch having a signal voltage applied thereacross.

6. The deterrence system of claim 5 wherein each said latching means comprises a reset-set bistable element.

7. The deterrence system of claim 1 wherein at least one of said circuit timing means has an additional timer arranged to prevent cascading of signals from one circuit to another.

8. The deterrence system of claim 1 wherein said response circuits are adapted to provide continuing response upon resetting of said latch means even after all but one of said sensors remain tripped.

9. The deterrence system of claim 1 wherein said second and additional staged response circuits each include additional timer means to prevent cascading of a signal through said system, and further to provide staging of said response within predetermined time periods.

* * * * *